US005289885A

United States Patent [19]

Sakoh

[11] Patent Number: 5,289,885

[45] Date of Patent: Mar. 1, 1994

[54] TIGHTENING TOOL

[75] Inventor: Masahiko Sakoh, Anjo, Japan

[73] Assignee: Makita Corporation, Anjo, Japan

[21] Appl. No.: 117,940

[22] Filed: Sep. 8, 1993

Related U.S. Application Data

[62] Division of Ser. No. 7,860, Jan. 22, 1993.

[30] Foreign Application Priority Data

Jan. 23, 1992 [JP] Japan ..... 4-34147

[51] Int. Cl.[5] ..... B25B 23/147

[52] U.S. Cl. ..... 173/2; 173/20; 173/109; 173/176; 81/467; 364/474.19; 364/508

[58] Field of Search ..... 173/2, 4, 5, 10, 11, 173/176, 20, 109, 178, 128, 206, 180; 81/467, 468, 469; 364/474.19, 508

[56] References Cited

U.S. PATENT DOCUMENTS

| | | | |
|---|---|---|---|
| 2,808,916 | 10/1957 | Johnson | 173/180 |
| 4,554,980 | 11/1985 | Doniwa | 173/176 |
| 4,699,223 | 10/1987 | Norén | 173/20 |
| 5,170,358 | 12/1992 | Delio | 364/508 |
| 5,174,387 | 12/1992 | Arndt et al. | 173/176 |

*Primary Examiner*—Scott Smith

*Attorney, Agent, or Firm*—Dennison, Meserole, Pollack & Scheiner

[57] ABSTRACT

A tightening tool includes a hammer for impacting on an anvil which drives a nut etc. A microphone is provided for converting impact sounds of the hammer on the anvil into an electric signal. A counting device counts the number of pulses of the electric signal. A setting device is provided for setting a set number of impacts to be obtained. A switch device compares the counted number of pulses with the set number and stops a motor for driving the hammer when the number of pulses coincides with the set number.

3 Claims, 10 Drawing Sheets

(when TR<0.5×MT)

(when TR>0.5×MT)

TIGHTENING TOOL

This is a divisional of application Ser. No. 08/077,860, filed Jan. 22, 1993 pending.

BACKGROUND OF THE INVENTION

1. Field of the Invention

The present invention relates to an improvement in a tightening tool such as an impact wrench or an impact screwdriver.

2. Description of the Prior Art

A tightening tool such as an impact wrench or an impact screwdriver is often used to firmly tighten a threaded object such as a bolt or a nut. The tightening tool includes a hammer rotatably driven by a drive source such as an electric motor or an air motor. Further, the tightening tool includes an anvil which serves to engage the object to be tightened for rotating the same. The hammer and the anvil are interlocked with each other in such a manner that the hammer rotates the anvil through an impact applied thereto but the hammer becomes idle relative to the anvil when a load more than a predetermined value has been applied from the hammer to the anvil. As long as the object is driven into a work by a relatively smaller load, the anvil is continuously rotated by the hammer, and therefore, the object is continuously driven. When the object has been tightened to the effect that the load applied between the anvil and the hammer exceeds the predetermined value, the hammer becomes idle but again impacts the anvil after it has been rotated by a predetermined angle. Thus, the hammer repeatedly becomes idle and impacts on the anvil. The anvil is rotated for each impact by the hammer, and the object is tightened for each rotation of the anvil. This kind of tightening tool is disclosed in Japanese Laid-Open Utility Model Publication No. 2-19476 and many other publications.

In this kind of tightening tool, a resulted tightening torque of the object depends on the number of impact by the hammer. Therefore, to tighten the object by a strong force, the hammer is rotated to impact the anvil frequently. This means that the tightening torque can be adjusted by adjusting the number of impact.

Japanese Patent Publication No. 51-43240 in the name of the same assignee as the present application discloses an improved technique for adjusting the tightening torque. In this technique, the tightening torque is adjusted by adjusting the time during rotation of a hammer without directly detecting the frequency of impact. This technique may effectively operate to drive objects such as screws of the same standard into threaded holes of the same standard to the effect that the objects are tightened by substantially constant torque. However, in case that the objects are those which can be tightened by relatively low torque and that the time required for driving the objects varies with the objects, a constant tightening torque may not be obtained.

Japanese Utility Model Publication No. 53-21836 discloses a technique to directly detect the frequency of impact. This technique has been developed in view of the fact that a hammer is retracted away from an anvil along the rotational axis of the hammer for each idle rotation of the hammer relative to the anvil. A proximity switch is disposed adjacent the retracted position of the hammer so as to count the frequency of retraction (which is equal to the frequency of impact) of the hammer. When the counted frequency reaches a predetermined number, a drive source (an electric motor) is stopped to drive the hammer.

The inventor of the present invention has carried out an experiment to see how the technique disclosed in Japanese Utility Model Publication No. 53-21836 operates. Thus, the inventor has disposed a proximity switch adjacent a retracted position of a hammer and has counted the frequency of retracting movement of the hammer. As a result of this, the inventor has found that the counted frequency has tendency not to exactly correspond to actual frequency and that constant tightening torque cannot be obtained. The inventor conjectures the reason of such incorrect counting as follows. Since the anvil and the hammer are repeatedly rotated at high speeds, grease is filled around the hammer for the purpose of lubrication. A certain kind of metal in the form of fine powder is normally dispersed in the grease for improving the lubricity. This means that the metal powder exists around the proximity switch. Because of existence of such metal powder, the proximity switch malfunctions to the effect that the frequency of the retracting movement cannot be correctly counted.

Further, since the retracting position of the hammer is normally at a forward end portion of a tightening tool, the technique of Japanese Utility Model Publication No. 53-21836 involves another problem that the number of process for manufacturing a tightening tool may increase and that the proximity switch tends to pick up noises.

SUMMARY OF THE INVENTION

It is, accordingly, an object of the present invention to provide a tightening tool which can correctly count the number of impact of a hammer on an anvil and which can be operated to reliably adjust the tightening torque.

According to the first aspect of the present invention, there is provided a tightening tool, comprising:

a hammer rotatably driven by a drive device;

an anvil driven by the hammer in such a manner that the hammer is rotated idly when the torque transmitted from the hammer to the anvil exceeds a predetermined value and that the hammer impacts on the anvil so as to rotate the anvil when the hammer is rotated by a predetermined angle after the hammer has been rotated idly;

a microphone for converting impact sounds of the hammer on the anvil into an electric signal;

a counting device for counting the number of pulses of the electric signal which corresponds to the number of impact;

a setting device for setting a set number of impact to be obtained; and a switch device for comparing the number of pulses counted by the counting device with the set number set by the setting device and for stopping the drive device when the number of pulses coincides with the set number.

With this construction, the number of impact of the hammer on the anvil can be correctly counted through counting of the impact sounds, and the existence of grease may not cause any problem that the counted number becomes incorrect. Therefore, the tightening tool can be adjusted to impart a correct tightening force through impact by a correct number.

The counting device, the setting device and the switch device may preferably be constructed by a microcomputer as their main component. Through such incorporation of the microcomputer, it becomes possible to program that the process for comparing the counted number with the set number may not be performed when the set number is a particular number. Thus, it becomes possible to continuously rotate the hammer after the counted number exceeds the particular number which may preferably be a possible maximum number to be set.

Further, the tightening tool may preferably be equipped with a paint spraying appliance which is operated to spray paint for a marking purpose on a subject to be driven when the number of impact reaches the set number and the rotation of the hammer is stopped to finish the tightening operation. This may permit an operator to easily recognize as to whether the subject has been correctly tightened by a predetermined torque.

The advantages of the first aspect of the present invention is that the number of impact can be correctly counted through detection of the impact sounds by the microphone; that the location of the microphone can be freely determined for detecting the impact sounds; and that the tightening tool such as an impact wrench is operable to correctly adjust the tightening torque can be manufactured at relatively low cost.

According to the second aspect of the present invention, there is provided a tightening tool, comprising:

a hammer rotatably driven by a drive device;

an anvil driven by the hammer in such a manner that the hammer is rotated idly when the torque transmitted from the hammer to the anvil exceeds a predetermined value and that the hammer impacts on the anvil so as to rotate the anvil when the hammer is rotated by a predetermined angle after the hammer has been rotated idly;

a microphone for converting impact sounds of the hammer on the anvil into an electric signal;

a comparing device for comparing the level of the electric signal with a reference level;

a detecting device for detecting the timing when the level of the electric signal exceeds the reference level;

a period calculating device for calculating a period of the timing based on at least two numbers of the detected timing;

a counting device for counting the number of impact from the number of timing when the level of the electric signal exceeds the reference level, the counting device being operable to compensate the counted number of impact based on the period calculated by the period calculating device;

a setting device for setting a set number of impact to be obtained; and a switch device for comparing the number counted by the counting device with the set number set by the setting device and for stopping the drive device when the counted number coincides with the set number.

With the second aspect of the present invention, even if any of the impact sounds could not be detected in spite of actual impact of the hammer on the anvil, the number of impact sounds which could not be detected can be compensated based on the calculated period of impacts, so that the number can be correctly Counted. Therefore, in addition to the same advantage as the first aspect, the second aspect provides an advantage that the correct number of impact can be counted so as to provide the correct tightening torque without being influenced by noises.

The invention will become more fully apparent from the claims and the description as it proceeds in connection with the drawings.

DETAILED DESCRIPTION OF THE PREFERRED EMBODIMENTS

An embodiment of the present invention will now be explained with reference to FIGS. 1 to 6.

Figure 1:
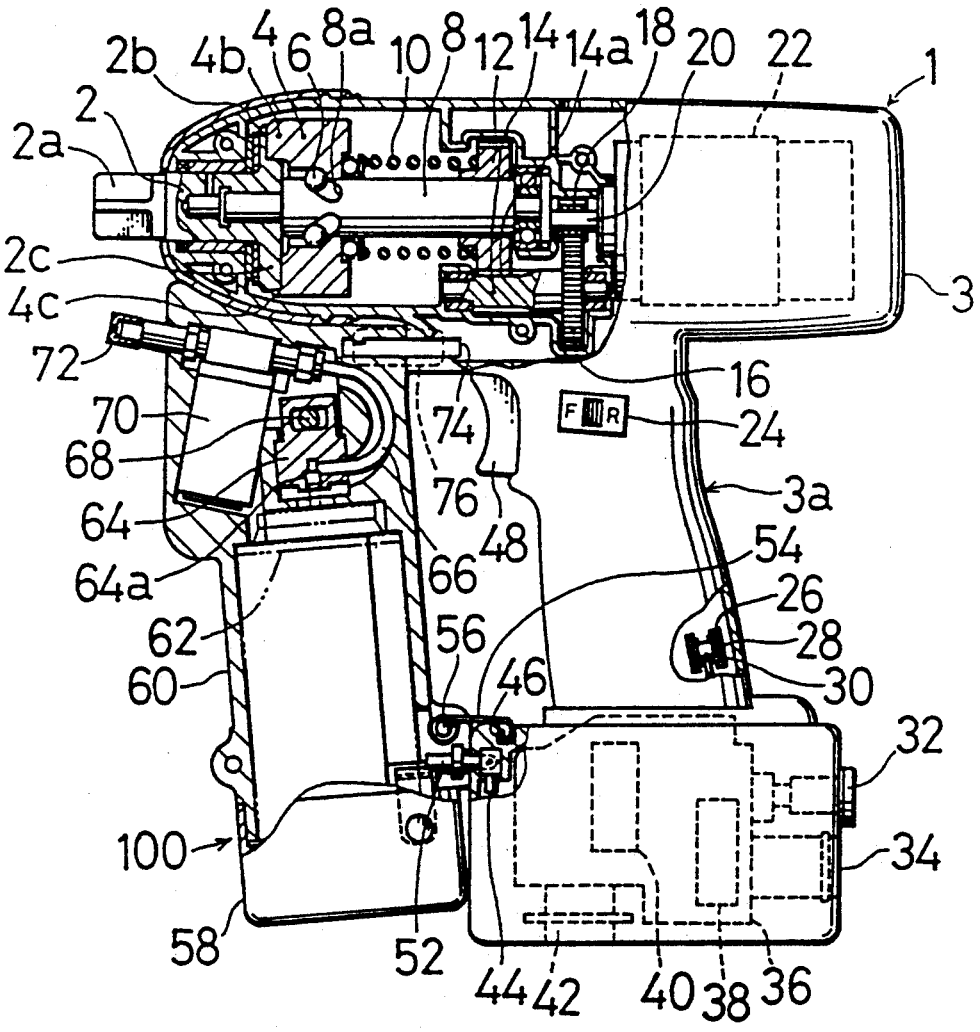
FIG. 1 is a side view, with a part broken away, of an impact wrench according to an embodiment of the present invention.

Referring to FIG. 1, there is shown an impact wrench 1 which is equipped with a marking appliance 100. A motor 22 is fixedly accommodated within a housing 3. A gear 18 is fixedly mounted on an output shaft 20 of the motor 22 and is in engagement with a gear 16 fixedly mounted on a shaft 14 which is rotatably mounted within the housing 3. A gear 14*a* is formed on the shaft 14 and is in engagement with a gear 12 fixedly mounted on a main shaft 8. The main shaft 8 is rotatably driven by the motor 22 through a reduction gear mechanism formed by the gears 18, 16, 14*a* and 12. A hammer 4 is rotatably mounted on the main shaft 8. A cam mechanism including a plural sets of a recess 8*a* and a ball 6 which is in engagement with the recess 8*a* is interposed between the hammer 4 and the main shaft 8. The recess 8*a* is formed on the main shaft 8 and extends obliquely relative to the longitudinal axis of the main shaft 8. The cam mechanism permits the hammer 4 to rotate with the main shaft 8 and permits the hammer 4 to move along the main shaft 8 in the longitudinal direction by a predetermined distance. A compression spring 10 is interposed between the hammer 4 and the gear 12 so as to normally bias the hammer 4 in a leftward direction in FIG. 1.

An anvil 2 is rotatably mounted on the forward end of the housing 3 for cooperation with the hammer 4. A forward portion 2*a* of the anvil 2 is polygonal in section for mounting thereon a box member (not shown) for engagement with a nut, etc. (not shown) to be driven.

A pair of protrusions 2*b* and 2*c* are formed on the rear end of the anvil 2 and extend in a diametrical direction. A pair of protrusions 4*b* and 4*c* are formed on the forward portion of the hammer 4 and extend in a diametrical direction. The protrusions 2*b*, 2*c* and the protrusions 4*b*, 4*c* are prepared for abutment on each other on their side surfaces and on a diametrical line.

When the nut, etc. is tightened by relatively low torque, the force transmitted between the protrusions 2*b*, 2*c* of the anvil 2 and the protrusions 4*b*, 4*c* of the hammer 4 as well as the force applied to the hammer 4 by the main shaft 8 through the cam mechanism or the balls 6 is relatively small, and the hammer 4 is kept at a position adjacent the anvil 2 by the biasing force of the spring 10. Therefore, the rotation of the main shaft 8 is continuously transmitted to the anvil 2 through the hammer 4, and the nut, etc. is continuously tightened. However, when the tightening torque becomes larger, the force transmitted between the protrusions 2*b*, 2*c* of the anvil 2 and the protrusions 4*b*, 4*c* of the hammer 4 as well as the force applied to the hammer 4 by the main shaft 8 through the cam mechanism or the balls 6 becomes larger, so that the force to move the hammer 4 rearwardly along the main shaft 8 becomes larger. Thus, when the force applied between the anvil 2 and the hammer 4 exceeds a predetermined value, the hammer 4 is moved rearwardly to disengage the protrusions 4*b*, 4*c* from the protrusions 2*b*, 2*c*, and the hammer 4 rotates idly relative to the anvil 2. As the protrusions 4*b*, 4*c* are moved to pass over their previously engaged protrusions 2*b*, 2*c*, the hammer 4 is moved forwardly by the biasing force of the spring 10. This means that the hammer 4 impacts on the anvil 2 after each rotation by a predetermined angle. Such idle rotation of the hammer 4 and its subsequent impact on the anvil 2 is repeatedly performed, and the nut, etc. is tightened by more stronger force as the number of impact increases.

A handle 3*a* extends downwardly from the housing 3. A switch 48 and a switch 22 is mounted on the handle 3*a* for starting the motor 22 and for changing the rotational direction of the motor 22, respectively.

Figure 3:
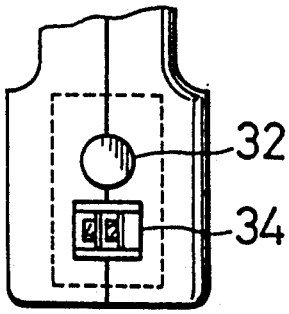
FIG. 3 is a rear view of a part of the impact wrench.

A control device is mounted on the bottom of the handle 3*a* and includes a volume controller 32 shown in FIGS. 1 and 3, a digital switch 34 operable by an operator for setting a number of two figures (the number "42" is set in FIG. 3), a connector 42 for connection with a plug from a battery (not shown), and a control substrate 36 on which electronic elements such as a microcomputer 38 and a relay 40 are installed.

A microphone 30 is mounted within the lower portion of the handle 3*a*. The microphone 30 is surrounded by a sponge 28 and is secured to a rib 26 formed with the handle 3*a*.

Figure 2:
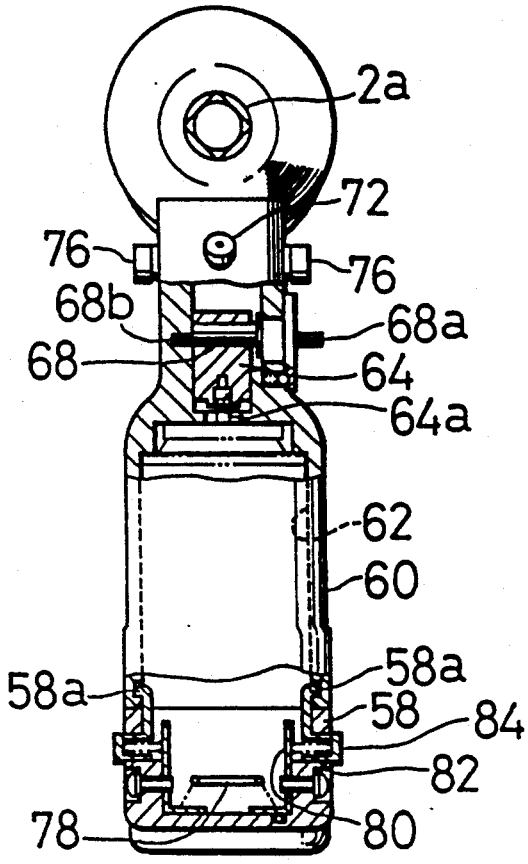
FIG. 2 is a front view, with a part broken away, of FIG. 1.

The construction of the marking appliance 100 will now be explained. The appliance 100 is constructed mainly by an upper housing 60 and a lower housing 58 for accommodating therewithin a paint spray can 62. A male plug 52 is fixed to the upper housing 60 for insertion into a female socket 44 mounted on the impact wrench 1. A hook 54 is pivotally mounted on the upper housing 60 through a pin 56. The hook 54 is engageable with a recess 46 formed on the impact wrench 1 for fixing the lower portion of the marking appliance 100 in position relative to the impact wrench 1. A shaft 74 is fixed to the upper portion of the marking appliance 100. The shaft 74 is insertable into a corresponding hole formed on the impact wrench 1. As shown in FIG. 2, a pair of hooks 76 are mounted on both lateral sides of the marking appliance 100. The hooks 76 are engageable with corresponding recesses (not shown) formed on the impact wrench 1 for fixing the upper portion of the marking appliance 100 in position relative to the impact wrench 1.

An operation member 64 for receiving a head portion of the spray can 62 is disposed within the upper housing 60 and is movable by a predetermined distance in a vertical direction in FIG. 1. An eccentric pin 68 extends through the operation member 64 in a horizontal direction. The eccentric pin 68 can be rotated around an axis 68*b* by a lever 68*a* shown in FIG. 2. In the state shown in FIG. 2, the eccentric pin 68 is rotated to lift the operation member 64, and the head portion of the spray can 62 is not pressed downwardly. Therefore, no paint is sprayed from the spray can 62. When the eccentric pin 68 is rotated to move the operation member 64 downwardly to press the head portion of the spray can 62, the paint is sprayed from the spray can 62. However, the head portion is connected to a nozzle 72 through a guide tube 66 within which a solenoid valve 70 is disposed. Therefore, the paint cannot be sprayed from the nozzle 72 unless the solenoid valve 7.0 is operated to be opened. Thus, the paint may not be exhausted from the spray can 62 as long as the operation member 64 is lifted by the eccentric pin 62, and the paint may be sprayed from the nozzle 72 during the time when the solenoid valve 70 is operated to be opened on the condition that the operation member 64 is lowered. The solenoid valve 70 is connected to the plug 52 through a lead wire (not shown).

As shown in FIG. 2, a spring 78 is provided within the lower housing 58 for biasing the spray can 62 upwardly. A pair of springs 82 are supported by a frame 80 and bias corresponding engaging claws 58*a* outwardly, respectively. The engaging claws 58*a* are operable by the operator through buttons 84. When the buttons 84 are pressed by the operator, the engaging claws 58*a* are moved toward each other and are disengaged from the upper housing 60, so that the lower housing 58 can be separated from the upper housing 60 for changing the spray can 62 to another one.

Figure 4:
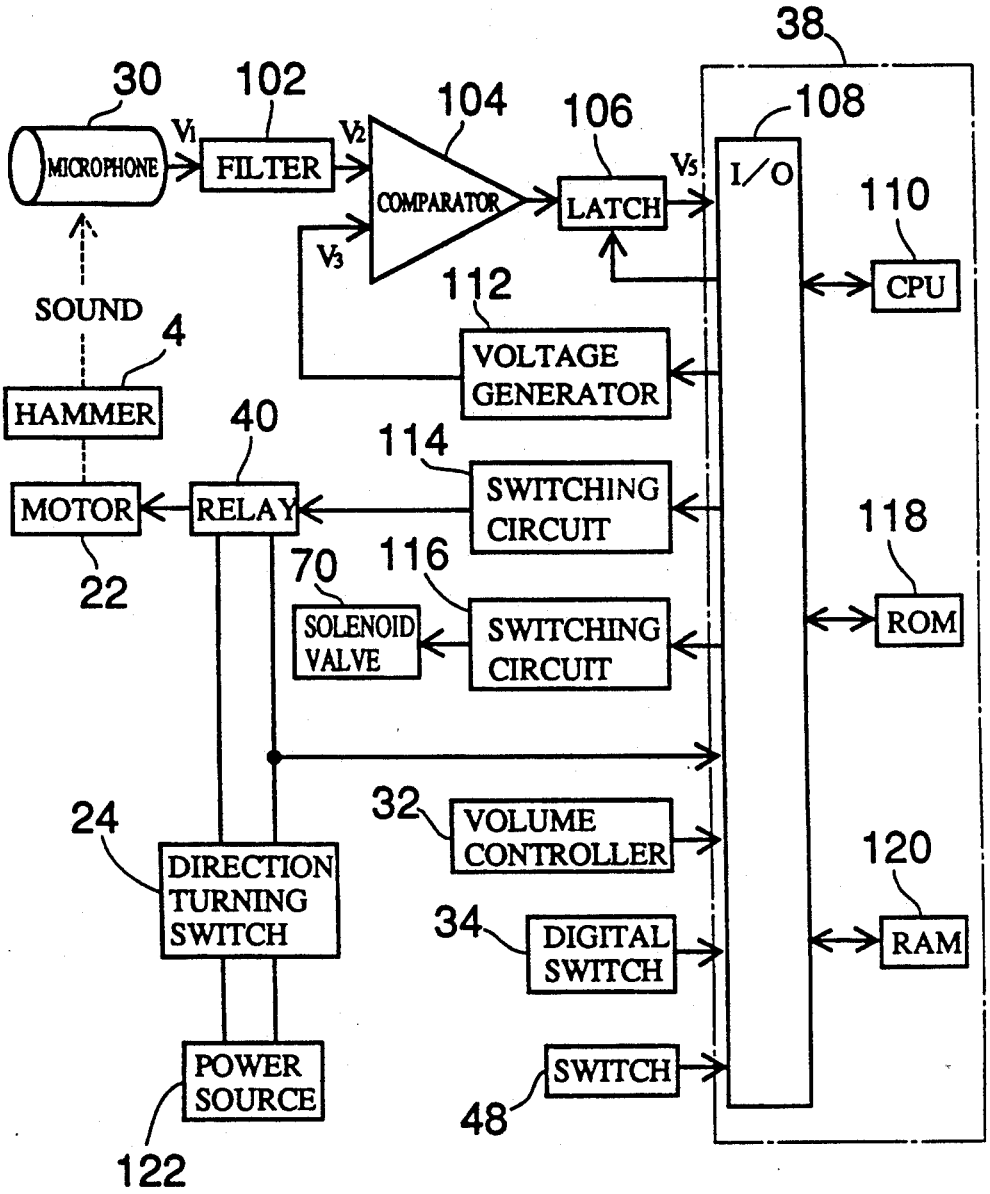
FIG. 4 is a block diagram showing a circuit configuration of the impact wrench.
Figure 5A:
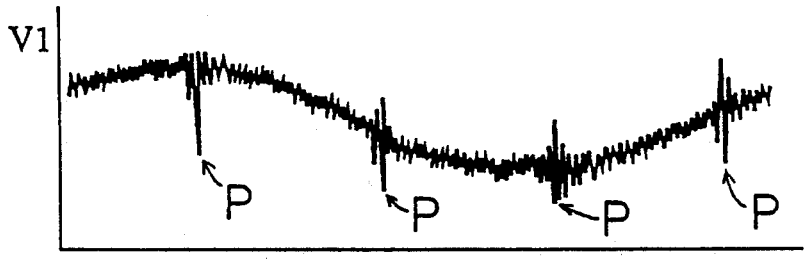
FIGS. 5(*a*) to 5(*d*) are graphs showing output voltages from a microphone, a filter and a latch circuit of the impact wrench.
Figure 5B:
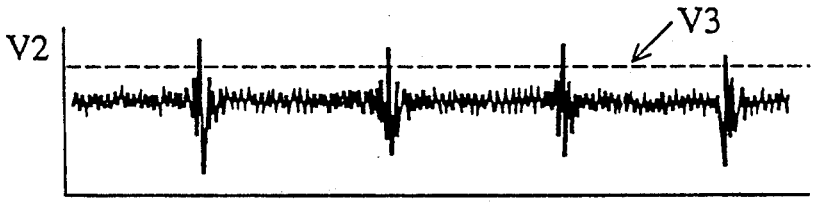
Figure 5C:
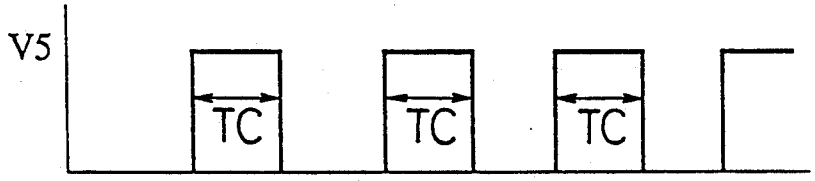
Figure 5D:
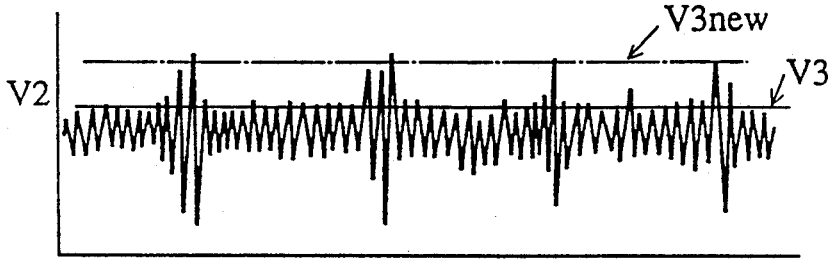

Referring to FIG. 4, there is shown a circuit configuration of the control device of the impact wrench 1.

The microcomputer 38 installed on the control substrate 36 includes a CPU 110, a ROM 118, RAM 120 and an I/O (interface) 108 as one chip. FIG. 4 shows how they are connected to each other. The microphone 30 is connected to one of terminals of a comparator 104 through a filter 102. A voltage generator 112 outputs a voltage V3 which is inputted to the comparator 104 through the other of the terminals. The microcomputer 38 adjusts the voltage V3 as will be explained later. An output voltage from the comparator 104 is inputted to the microcomputer 38 through a latch 106. The latch 106 may be turned from on to off by the microcomputer 38.

A battery pack 122 as a power source is connected to the motor 22 through the connector 42, the switch 24 for converting the rotational direction of the motor 22 and the relay 40. The relay 40 is connected to the microcomputer 38 through a first switching circuit 114. The solenoid valve 70 for spraying the paint is connected to the microcomputer 38 through a second switching circuit 116. The volume controller 32, the digital switch 34 and the main switch 48 are also connected to the microcomputer 38.

When the motor 22 has been started to rotate the hammer 4, impact sounds are produced at each impact of the hammer 4 on the anvil 2, and the microphone 30 produces a voltage V1 as shown in FIG. 5(*a*). The voltage V1 is a pulse wave corresponding to the impact sounds on which noises including those of high and low frequency such as motor sounds are superimposed. The noises of low frequency is eliminated by the filter 102, and therefore, the filter 102 outputs a voltage as designated by V2 in FIG. 5(*b*). The comparator 104 turns from off to on when the filtered voltage V2 becomes higher than the voltage V3 which is a reference voltage.

The latch 106 turns on in response to turning of the comparator 104 from off to on and keeps on during a predetermined time TC until the microcomputer 38 turns the latch 106 off. Thus, the latch 106 outputs a pulse wave as designated by V5 in FIG. 5(*c*). Each pulse of the pulse wave V5 is produced when the hammer 4 impacts on the anvil 2 and corresponds to an impact sound.

As shown in FIG. 5(*b*), the reference voltage V3 of the comparator 104 is determined to have a level higher than a level of the noises. According to the environmental condition, if the noises are of relatively higher level, the reference voltage V3 may be adjusted to a voltage V3new which has a larger value than the reference voltage V3 as will be explained later.

Figure 6:
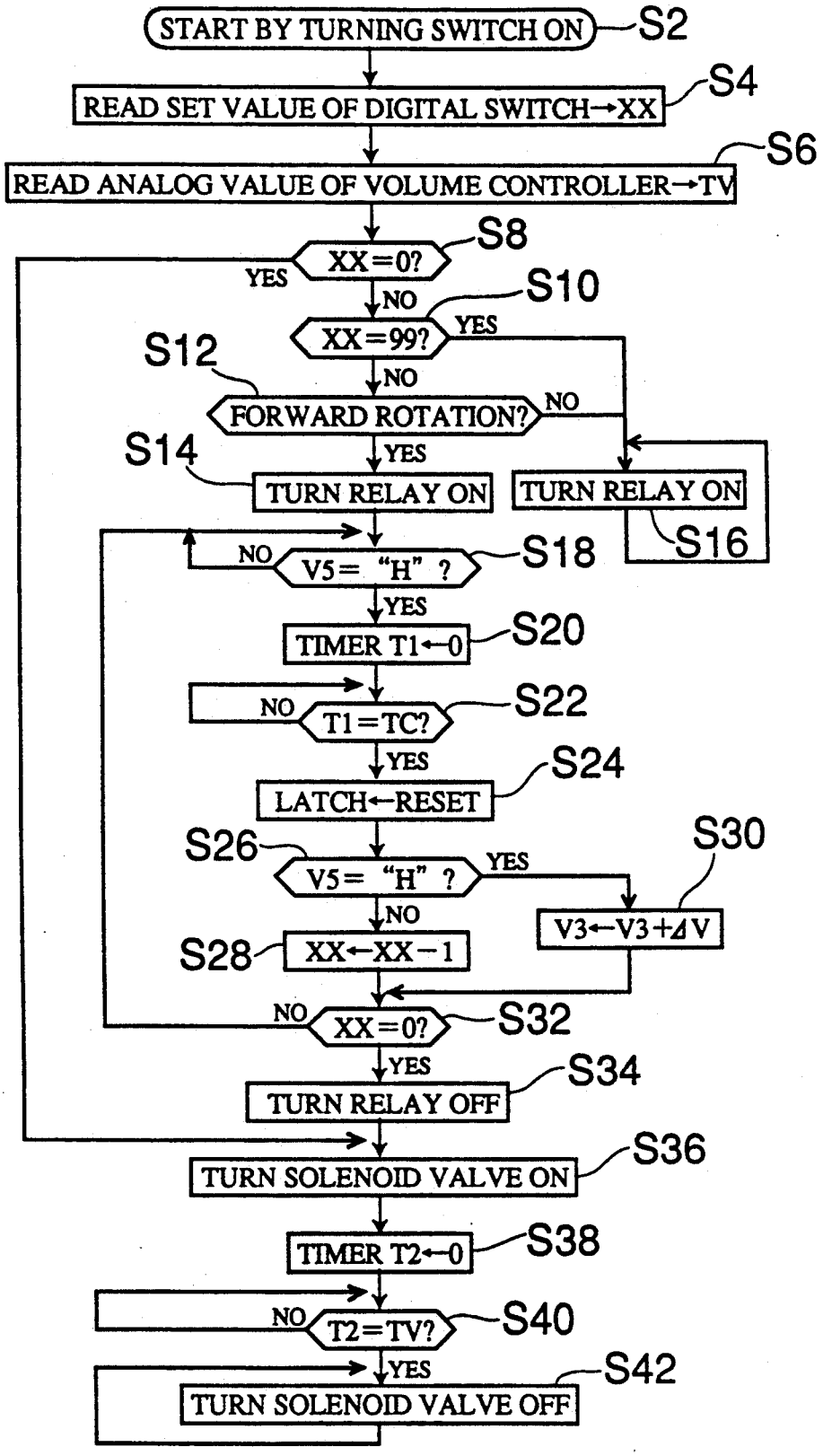
FIG. 6 is a flowchart showing a process performed by a microcomputer of the impact wrench.
Figure 7:
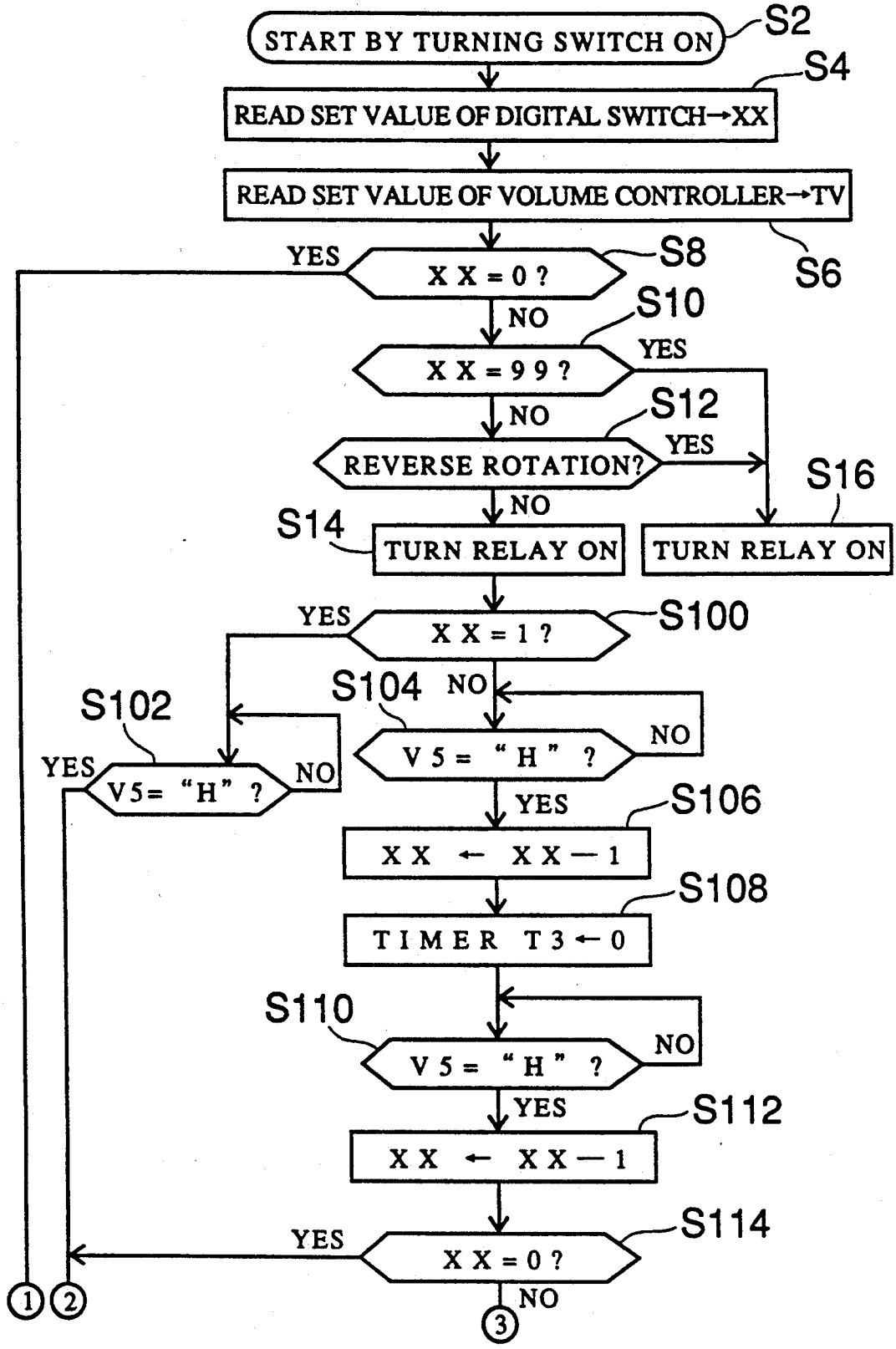
FIGS. 7 to 9 are flowcharts similar to FIG. 6, but showing another embodiment.
Figure 8:
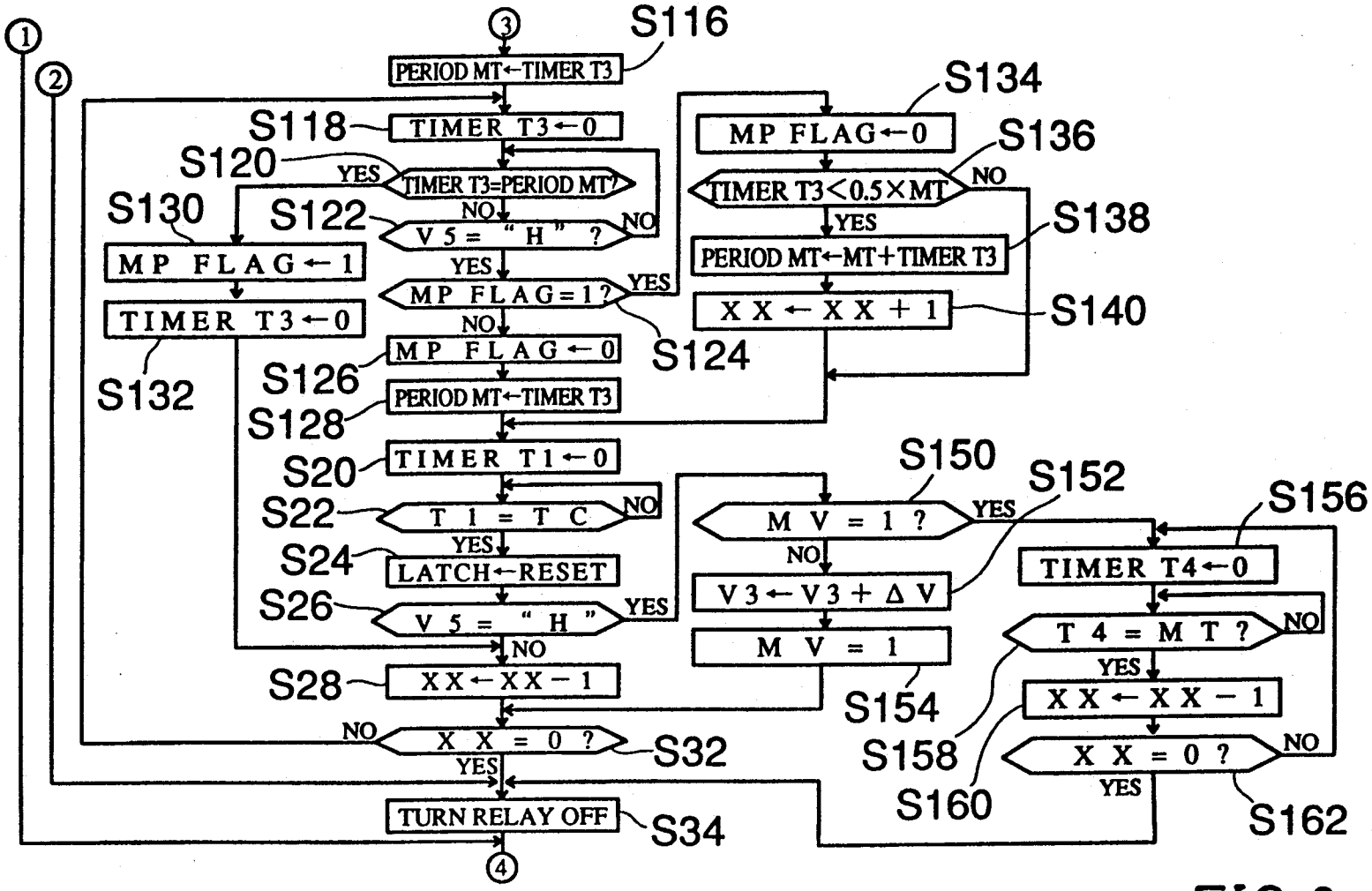
Figure 9:
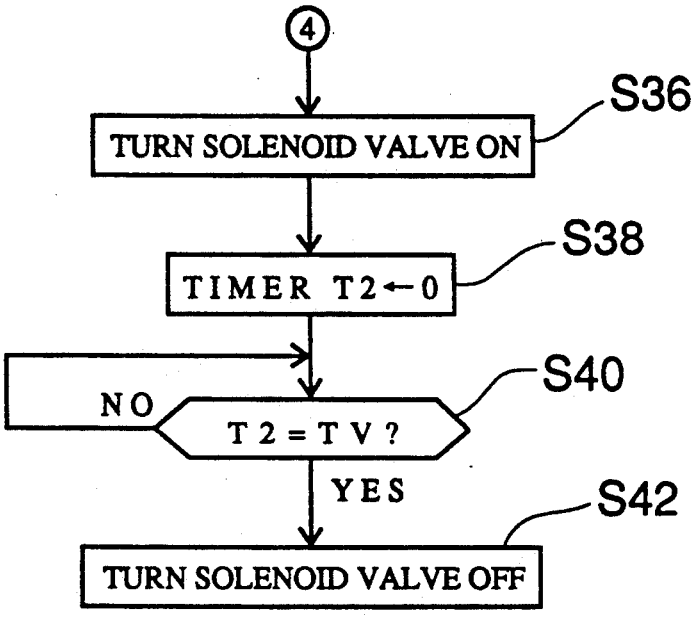
Figure 10A:
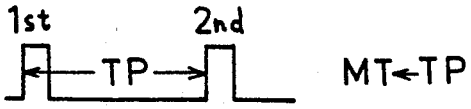
FIGS. 10(*a*) to 10(*j*) are schematic graphs showing the process performed according to the flowcharts of FIGS. 7 to 9.
Figure 10B:
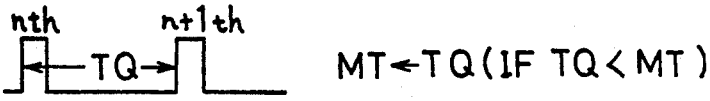
Figure 10C:
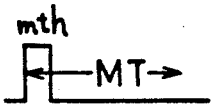
Figure 10D:
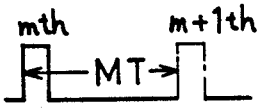
Figure 10E:
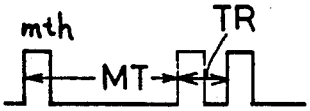
Figure 10F:
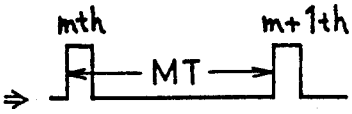
Figure 10G:
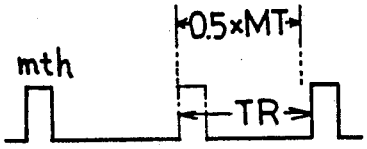
Figure 10H:
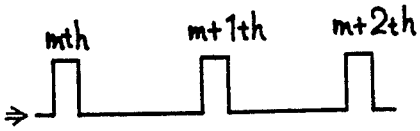
Figure 10I:
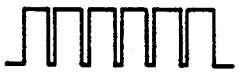
Figure 10J:
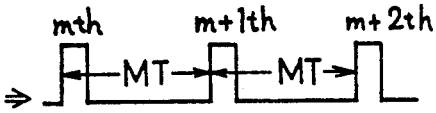

The microcomputer 38 performs a process as shown in FIG. 6 according to a program stored in the ROM 118. The process is proceeded as long as the main switch 48 is turned on and is terminated when the main switch 48 is turned off. The process is again started when the main switch 48 is again turned on.

Upon turning of the main switch 48 to on, the process proceeds to Step S4. In Step S4, the number set by the digital switch 34 is read by the microcomputer 38 and is stored as a variable XX. Subsequently, an analog value set by the volume controller 32 is read by the microcomputer 38 and is stored as a variable TV (Step S6). The process further proceeds to Step S8 in which the microcomputer 38 determines as to whether the value set by the digital switch 34 is "0" or not. If the value is "0", the process skips Steps S10 to S34 and proceeds directly to Step S36. In Step S36, the solenoid valve 70 is operated to be opened for spraying the paint. The process proceeds to Steps S38 and S40 for delaying the process during the time which is in proportion to the variable TV adjusted by the volume controller 32. After such time has been passed, the process proceeds to Step S42 to operate the solenoid valve 70 to be closed. Thus, the operator can adjust the time for spraying the paint through adjustment of the volume controller 32. As will be apparent from the above description, if the value "0" is set by the digital switch 34, the process skips Steps S10 to S28 in which a count process of the number of impacts and a start process of the motor 22 are performed, and therefore, only the process for spraying the paint is performed. This means that the operator can conduct a test for spraying the paint by setting the value "0".

If the set value is not "0" in Step S8, the process proceeds to Step S10 in which the microcomputer 38 determines as to whether the set value is "99" or not. Here, the value "99" is a maximum value which can be set by the digital switch 34. If the value "99" is set, the process proceeds to Step S16 to turn the relay 40 on. Thus, if the value "99" is set, the motor 22 is kept driven as long as the main switch 48 is kept on. This means that the operator can perform a continuous tightening operation by setting the value "99".

If any of the value "0" and the value "99" is not set by the digital switch 34, the process proceeds to Step S12 in which the microcomputer 38 determines as to which direction between the forward direction and the reverse direction is set by the switch 24. Such determination may be performed by detecting a potential at one of lead wires which connect the switch 24 to the relay 40 since this potential changes in response to turning of the switch 24. If the reverse direction is determined in Step S12, the process proceeds to Step S16 to continuously drive the motor 22. Thus, if the reverse direction is set by the switch 24, the motor 22 is driven until the main switch 48 is turned off, so that the operation for releasing the nut, etc. can be performed.

On the other hand, if the forward direction is determined in Step S12, the process proceeds to Step S14 to turn the relay 40 on so as to start the motor 22. The process further proceeds to Step S18 to wait until the latch voltage V5 becomes high or on. When the latch voltage V5 becomes high or on, the process proceeds to Step S20 in which a timer T1 is set to "0". The process further proceeds to Step S22 to wait until the timer Tl counts the time TC. After the timer Tl has counted the time TC, the process proceeds to Step S24 to reset the latch 106. The latch voltage V5 therefore becomes low or off after the time TC has passed as shown in FIG. 5(*c*). The process thereafter proceeds to Step S26 to determine as to whether the latch 106 has again become high or on immediately after it has become low or off. Here, in case that the reference voltage V3 is too lower than the noise level, the latch 106 is turned on immediately after it has become low or off. In such a case, the process proceeds to Step S30 to increase the reference voltage V3 by a voltage ΔV. The voltage thus increased is shown in FIG. 5(*d*) as the voltage V3new, and the voltage ΔV is previously determined in such a manner that the voltage V3new has a larger value than the noise level which has been increased by change of the environmental condition. If the latch 106 has not been turned on in Step S26, the microcomputer 38 subtracts "J" from the set value of the digital switch 34 (Step S28). The microcomputer 38 thereafter determines as to whether the result of the subtraction of "1" has become "0" or not (Step S32). If the result is "0", the process proceeds to Step S34 to turn the relay 40 off, so that the motor 22 is stopped. If the result is not "0", the process after Step S18 is repeatedly performed, so that the motor 22 is stopped when the hammer 4 has impacted on the anvil 2 by the set number of the digital switch 34. After the motor 22 has been stopped, the process proceeds to Step S36 and its subsequent steps to spray the paint during the time set by the volume controller 32.

In the above embodiment, the filter 102, the comparator 104, the latch 106 and a corresponding part of the microcomputer 38 for conducting Step S28 constitute a counting device for counting the number of pulses corresponding to the impact sounds. The digital switch 34 and a corresponding part of the microcomputer 38 for performing Step S4 constitute an impact number set device for setting a number of impact to be obtained. A corresponding part of the microcomputer 38 for performing Steps S32 and S34, the first switching circuit 114 and the relay 40 constitute a switch device for stopping the motor 22 when the counted number coincides with the set number. Thus, the counting device and the impact number set device are constructed mainly by the microcomputer 38. Further, in this embodiment, by the process of Steps S8 and S10 to skip Steps S28, S32, S34, etc., if a particular number ("0" or "99" in this embodiment) is set by the impact number set device, the process to compare the counted number with the set number is not performed. Additionally, in this embodiment, a corresponding part of the microcomputer 38 for performing Step S36 and its subsequent steps, and the second switching circuit 116 constitute a second switch device to operate the spray appliance 100 when the counted number coincides with the set number.

According to this embodiment, the tightening number can be correctly detected based on the impact sounds, and therefore, the tightening force can be correctly adjusted. Further, the reference voltage V3 used for extracting the impact sounds can be automatically adjusted in response to the noise level. Additionally, the head portion of the spray can 62 is operable by the eccentric pin 68 to be pressed or to be released. Therefore, if the appliance 100 is not intended to be used for a long time, by maintaining the head portion at the released position, the paint can be prevented from being dried and clogged within the guide tube 66.

Another embodiment of the process performed by the microcomputer 38 will now be explained with reference to FIGS. 7 to 11. The process of this embodiment is planned, based on the process of the above embodiment, to further perform a compensation process in case that the impact number cannot be correctly counted because of the influence of the noises. In FIGS. 7 to 11, the same steps as the first embodiment are labeled by the same number, and an explanation of these steps is omitted.

In this embodiment, the process for the test spray in case that the value "0" is set by the digital switch 34, the process for the continuous tightening operation in case that the value "99" is set by the digital switch 34, and the process in case that the reverse direction is set by the switch 24 are the same as the above embodiment.

In case that the forward direction is set by the switch 24, the relay 40 is turned on in Step S14 to start the motor 22. Immediately after the motor 22 has been started, the microcomputer 38 determines as to whether the value "1" is set by the digital switch 34 (Step S100). If the value "1" or the impact number "1" is set, the process proceeds to Step S102 to wait until the latch voltage V5 becomes high or on. When the latch voltage V5 becomes high or on, the process proceeds to Step S34 to turn the relay 40 off so as to stop the motor 22. Thus, in this case, the process waits until the latch voltage V5 becomes high or on for the first time after the motor 22 has been started. The motor 22 is stopped when the latch voltage V5 becomes high or on for the first time. The process for the impact number "1" is thus performed. After the motor 22 is stopped, the process proceeds to Step S36 for the marking process of the tightened nut, etc.

In case that "2" or more impact number is set by the digital switch 34, the result of determination in Step S100 becomes NO, and therefore, the process proceeds to Step S104. In step S104, the process also waits until the latch voltage V5 becomes high or on for the first time. When the hammer 4 impacts on the anvil 2 for the first time, the result of determination in Step S104 becomes YES, and the process proceeds to Step S106. In Step S106, "1" is subtracted from the variable XX to the effect that the count of the impact number is increased by "1". At this timing, the timer T3 is initialized to "0" (Step S108). After completion of this process, the process proceeds to Step S110 to wait until the latch voltage V5 becomes high or on for the second time. When the hammer 4 impacts on the anvil 2 for the second time, the determination in Step S110 becomes YES, so that the count of the impact number is further increased in Step S112. Subsequently, In Step S114, the variable XX is determined as to whether it has become "0". If the number "2" is set by the digital switch 34 for the first time, the determination in Step S114 becomes YES which means that the hammer 4 has impacted on the anvil 2 for two times, and the process proceeds to Step S34 to stop the motor 22.

In case that "3" or more number is set by the digital switch 34, the process performs to count the impact number with the count number being compensated for with reference to the period of impact. Step S116 and its subsequent steps are prepared for such process.

Firstly, in Step S116, the time when the determination in Step S110 becomes YES or the time T3 when the second impact sound is produced is determined as a period MT of the impact. Since the timer T3 has been initialized to "0" in Step S108 when the impact sound has been produced for the first time, the time between the first production of the impact sound and the second production of the same corresponds to the period MT. The timer T3 is thereafter initialized in Step S118.

After completion of this process, the process proceeds to Steps S120 and S122 to determine as to whether the next impact sound has been detected within the period MT. Although the next impact sound is the third impact sound in this case, it may be the fourth or more further subsequent impact sound since this process is repeatedly performed until the determination in Step S32 becomes NO. If the next impact sound has been detected within the period MT, the determination in Step S122 becomes YES and the process proceeds to Step S124. In Step S124, the microcomputer 38 determines the contents of an MP flag which is set to "1" in Step S130. As will be apparent from the following description, the MP flag is set to "0" if the impact sound produced just before has been actually detected, while the MP flag is set to "1" if the microcomputer 38 has performed to compensate for the impact sound which has not been detected at a timing when it must have been detected. In case that the impact sound has been actually detected by two times during the period MT as shown in FIG. 10(*b*), the determination in Step S122 becomes YES while the determination in Step S124 becomes NO. Since the impact sound to be detected has been actually detected in this case, the MP flag is set to "0" in Step S126, and the period MT is renewed in Step S128 for the latest one which has been counted by the timer T3. Thus, as will be apparent from FIGS. 10(*a*) and 10(*b*), the period MT is renewed to the latest one if the latest one is shorter than the present one. As the result of this, the period MT may have a correct value even if the timing detected in Step S110 was actually that of the third impact sound.

In case that the next impact sound has not been detected during the period MT, the determination in Step S120 becomes YES. This means that the impact sound has not been detected at the timing when it must have been detected. To this end, in Step S130, the microcomputer 38 sets the MP flag to "1" indicating that the process to compensate for the impact sound which has not been actually detected is performed. At the same time therewith, the timer T3 is initialized to "0" in Step S132. As was previously described, the MP flag is reset to "0" in Step S126. The MP flag is also reset to "0" in Step S134 as will be described later. Thus, the MP flag is reset to "0" if the impact sound has been actually detected in Step S122.

In case that the determination in Step S120 has become YES because of non-detection of the impact sound at the timing when it must have been detected, and that the process has been performed according to Steps 130 and 132, the process proceeds to Step S28 to increase the count number of the impact sound by "1".

Thus, if the impact sound has not been detected at the timing when it must have been detected, to compensate for such non-detected impact sound, the impact number is increased as if such impact sound has been actually detected. To indicate that such compensation process is performed, the MP flag is set to "1". FIGS. 10(*c*) and 10(*d*) illustrate how the compensation process is performed to compensate for the non-detected impact sound during the period MT.

As for the compensation count process, unless the result in Step S32 becomes "0", the process returns to Step S118 to repeat the process in Steps S120 and S122. If the impact sound has been actually detected after the compensation count process, the determination in Step S124 becomes YES and the process proceeds to Step S134 for resetting the MP flag to "0" so as to indicate that the compensation process has been stopped. The process further proceeds to Step S136 in which the microcomputer 38 determines as to whether the situation is that shown in FIG. 10(*e*) or that shown in FIG. 10(*g*). FIG. 10(*e*) shows the case that the impact sound detected after the compensation process has appeared nearly the timing when such impact sound must have been detected and that the detected impact sound has merely been delayed to appear without any failure of detection of the former impact sound. FIG. 10(*e*) shows the case that the detected impact sound has been delayed to appear by a significant time and that the former impact sound has not been detected. Practically, the determination is performed by judging as to whether a delayed time TR is within or longer than half the period MT. If the delayed time TR is within half the period MT, the microcomputer 38 determines that the detected impact sound has merely been delayed to appear without any failure of detection of the former impact sound. In this case, the process proceeds to Step S138 in which the period MT is renewed to have the latest value, and further proceeds to Step 140 to offset the compensated count. FIG. 10(*e*) shows how these steps are performed. On the other hand, if the delayed time is longer than half the period MT, the microcomputer 38 determines that the former impact sound has not been detected and that the detected impact sound is that thereafter produced. In this case, since the compensated count may be remained, the process skips Step S140 and no process to renew the period MT is performed.

Since the actual impact sound will be detected after the timing when the impact sound must have been detected and the compensation process has been performed for such non-detected sound as described above in connection with FIG. 10(*e*), it is necessary to recognize such actual impact sound. On the other hand, in case that such actual sound has been detected, no additional impact sound will be produced immediately after detection of such actual sound. Therefore, it is preferable to prevent such additional impact sound from being erroneously detected. Steps S20 to S24 are prepared for this purpose. In this process, the timer Tl is set to "0" in Step S20 when the impact sound has been actually detected. The latch 106 is thereafter delayed to be reset for the time TC in Steps S22 and S24. Thus, the detection of the impact sound is not performed during the time TC. Here, the time TC is determined to be slightly shorter than the period MT of the impact sounds which may be produced when the impact is repeated at a possible highest speed. By such determination of the time TC to have a possible largest value, the chance of erroneous detection may be extremely reduced.

The process further proceeds to Step S26 in which the microcomputer 38 determines as to whether the impact sound has been again detected after the time TC. If the determination is YES, it means that the noises are at a higher level and that they have been detected as the impact sound. In this case, the reference voltage V3 of the comparator 104 is increased in Step S152, and a flag MV is set to "I" in Step S154. The determination in Step S150 becomes YES when the impact sound has still been detected after the time TC even if the reference voltage V3 has been increased. This situation indicates that the noise level is considerably high and that it becomes substantially impossible to count the impact number from the impact sound. In such a case, the microcomputer 38 performs thereafter a process to count the impact on the assumption that the impact has been made for each period MT. When the period MT has been repeated to reach the number corresponding to the set number, the motor 22 is stopped in Step S34. This process is shown in FIGS. 10(*i*) and 10(*j*).

Figure 11:
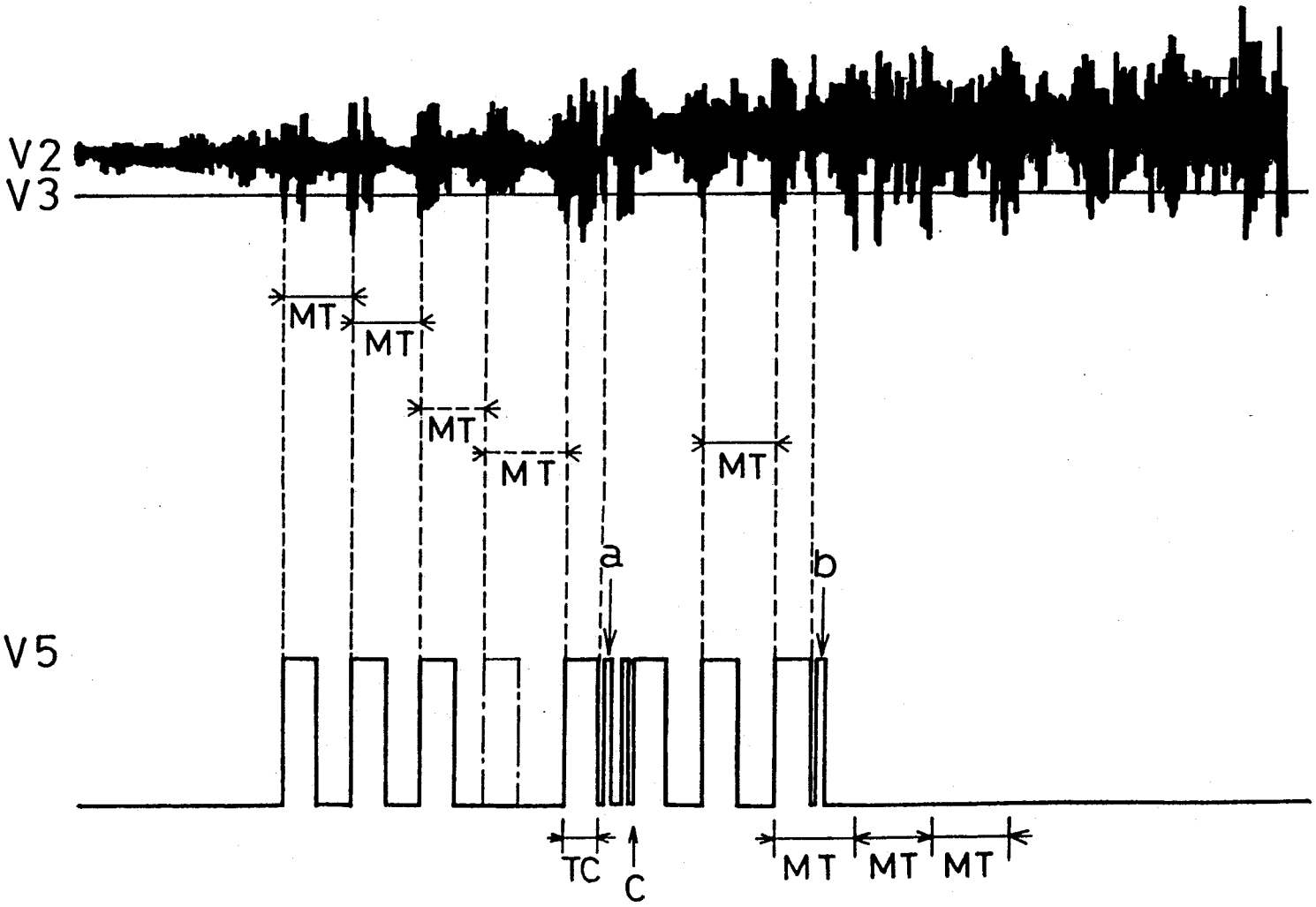
FIG. 11 is a graph showing an example of the result of the process performed according to the flow charts of FIGS. 7 to 9.

FIG. 11 shows an experimental result of the process according to this embodiment. At the period immediately after starting the impact operation, the impact sounds are relatively correctly detected by the microphone 30, so that the period MT can be correctly determined. As the tightening operation further proceeds, an echo from a work such as a steel frame to be tightened increases, and therefore, the noises also increase. In FIG. 11, a timing a indicates the timing when the process in Step S152 is performed in response to the increase of the noise level. In this experiment, the influence of the noises has been eliminated by increasing the voltage V2 in place of the increase of the voltage V3. Further, the comparator 104 used in this experiment is that which is operated to be turned on when the detected voltage V2 becomes lower than the reference voltage V3. A timing b indicates the timing when the determination in Step S150 becomes YES because of erroneous detection of the impact sound irrespective of the increase of the voltage V2. FIG. 11 also shows that the impact sound is continuously counted based on the latest period MT after the timing b. Further, a timing c indicates the timing when the impact number is counted for compensation.

In this embodiment, the filter 102, the comparator 104 and the latch 106 constitute a device for comparing the detected level of the microphone 30 with the reference level V3. A corresponding part of the microcomputer 38 for performing Steps S104 and S110 in FIG. 7 constitutes a device for detecting the timing when the detected level exceeds the reference level. A corresponding part of the microcomputer 38 performing Steps S116 and S128 constitutes a device for calculating the period MT. A corresponding part of the microcomputer 38 performing Steps S106, S112 and S28 constitutes a count device for actual detected number. A corresponding part of the microcomputer 38 for performing Step S28 performed after Step S132, and Step S140 constitutes a device for compensating the counted number. The digital switch 34 and a corresponding part of the microcomputer for performing Step S4 constitute an impact number set device for previously set the impact number. A corresponding part of the microcomputer 38 for performing Steps S32 and S34, the first switching circuit 114 and the relay 40 constitute a switch device for stopping the motor 22 when the counted number coincides with the set number. Thus, all of the device for detecting the timing, the device for calculating the period, the devices for counting and compensating, the device for setting the impact number and the switch device include the microcomputer 38 as the main constituents.

In this embodiment, the period MT is renewed based on the latest timing of production of the impact sound. However, by using the microcomputer 38 having a large throughput, it becomes possible to calculate an average period of the previous impact sounds, so that the compensation of the impact number can be performed using the average period.

While the invention has been described with reference to preferred embodiments, it is to be understood that modifications or variation may be easily made without departing from the spirit of this invention which is defined by the appended claims.

What is claimed is:

1. A tightening tool, comprising:

a hammer rotatably driven by drive means;

an anvil driven by said hammer in such a manner that said hammer is rotated idly when the torque transmitted from said hammer to said anvil exceeds a predetermined value and that said hammer impacts on said anvil so as to rotate said anvil when said hammer is rotated by a predetermined angle after said hammer has been rotated idly;

a microphone for converting impact sounds of said hammer on said anvil into an electric signal;

comparing means for comparing the level of the electric signal with a reference level;

detecting means for detecting timing when the level of the electric signal exceeds the reference level;

period calculating means for calculating a period of the timing based on at least two numbers of the detected timing;

counting means for counting the number of impact from the number of timing when the level of the electric signal exceeds the reference level, said counting means being operable to compensate the counted number of impact based on the period calculated by said period calculating means;

setting means for setting a set number of impact to be obtained; and switch means for comparing the number counted by said counting means with the set number set by said setting means and for stopping said drive means when the counted number coincides with the set number.

2. The tightening tool as defined in claim 1 and further including latch means for keeping the result of comparison by said comparing means during a time TC, the time TC being determined to be slightly shorter than a possible shortest impact period.

3. The tightening tool as defined in claim 2 and further including means for determining as to whether the result of comparison has been once changed immediately after said latch means has kept the result of comparison, and means for changing the reference level when said determining means determines that the result has been once changed.

* * * * *